United States Patent [19]

Hughes

[11] 3,963,165

[45] June 15, 1976

[54] SCORED BLANK TO BE FOLDED INTO DISPOSABLE SAVINGS BANK

[76] Inventor: Jan Hughes, 548 Riverside Drive, 3A, New York, N.Y. 10027

[22] Filed: Dec. 24, 1974

[21] Appl. No.: 536,246

[52] U.S. Cl. ..... 229/8.5; 229/38

[51] Int. Cl.[2] ..... A45C 1/12; A63H 33/30; B65D 5/08

[58] Field of Search ..... 229/8.5, 39 R, 36, 38, 229/45

[56] References Cited

UNITED STATES PATENTS 877,951 2/1908 Roberts ..... 229/8.5 R 3,506,181 4/1970 Farquhar ..... 229/39 R

OTHER PUBLICATIONS

IBM Bulletin vol. 15, No. 9, Feb. 1973, Dunning, et al.

*Primary Examiner*—William Price
*Assistant Examiner*—Douglas B. Farrow
*Attorney, Agent, or Firm*—Davis, Hoxie, Faithfull & Hapgood

[57] ABSTRACT

A scored blank adapted to be folded into container form suitable for use as a disposable savings bank.

1 Claim, 9 Drawing Figures

THE BOWERY

SCORED BLANK TO BE FOLDED INTO DISPOSABLE SAVINGS BANK

This invention relates to scored blanks adapted to be folded into container form and particularly to a blank that can be conveniently mailed, for example, by a savings institution in an ordinary business envelope and can readily be folded and assembled by the recipient into an attractive and useful bank for saving coins or bills.

Although box blanks of many types have been known and used heretofore to make boxes for a variety of purposes, none, so far as I am aware, have been or could effectively be adapted for the purpose of this invention.

In accordance with the invention, the blank is formed as an elongated body of uniform width, scored transversely into a plurality of side panels, preferably at least four, to be joined in a box-like structure of predetermined peripheral configuration and dimensions. A top or end panel, conforming in its periphery to the peripheral configuration and dimensions of the box-like structure joins the elongated body at one edge thereof along an inner score line co-extensive with one of the said panels and extends laterally therefore to an infolding tab joining the end panel at an outer score line. Locking notches are provided at both ends of said outer score line. When the side panels are folded into the box-like structure, one of the side panels is positioned opposite the inner score line and is adapted to receive the tab when so infolded on the outer score line. Each of the side panels lying contiguous to said opposite panel when the blank is folded has a flap joining the said contiguous side panel at a score line and extends laterally from the elongated body in the same direction as the said end panel extends. A recessed shoulder is formed in each of said flaps in proximity to said opposite panel adapted to interlock with said notches to secure the end panel in closed position. A similar end panel is provided to form the box bottom and one of the end panels is slotted for the insertion of money into the box-like structure thus formed.

Figure 1:
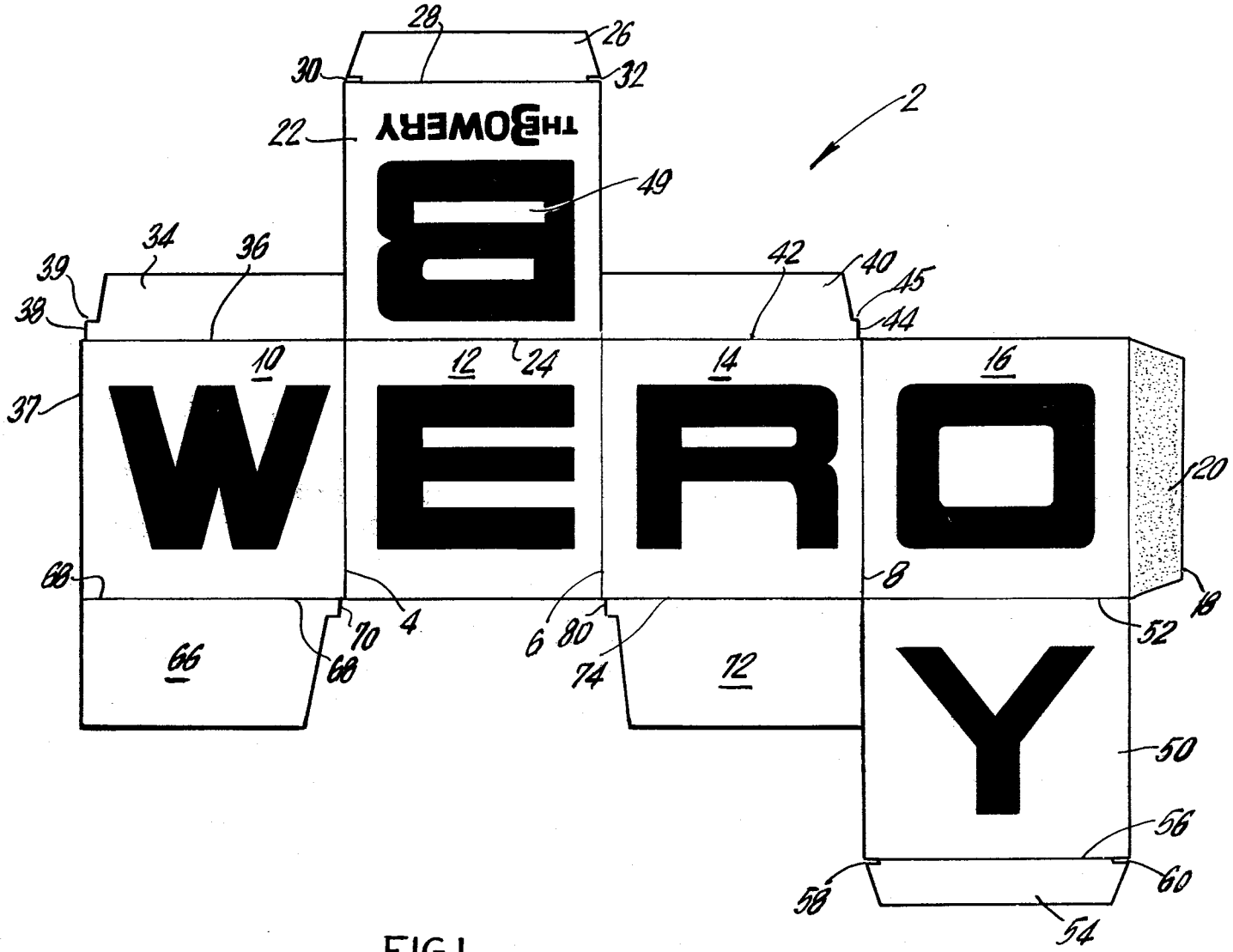
FIG. 1 is a view of the scored blank of the present invention.
Figures 2, 3, 4, 5, 6, 7, 8, 9:
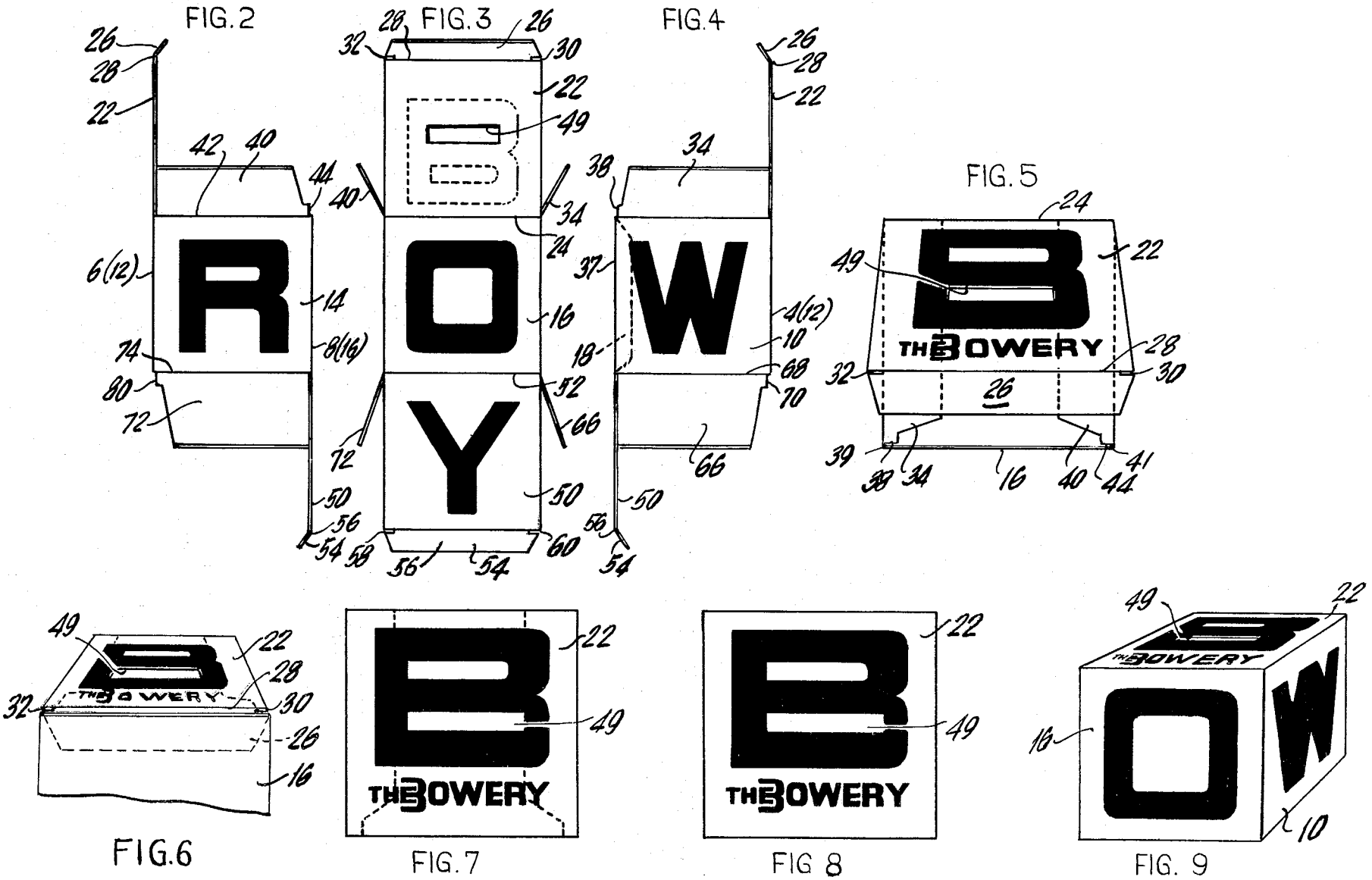
FIG. 2 is a side elevation view of the blank showing the side panels folded into a box-like structure and secured as will appear.
FIG. 3 is an elevation view of FIG. 2 looking from the right.
FIG. 4 is an elevation view of FIG. 3 looking from the right.
FIG. 5 is a perspective view looking downwardly on the box as the top panel is being infolded.
FIG. 6 is a perspective view of the upper part of the box showing the top panel nearly in closed position.
FIG. 7 is a plan view of the box showing in dotted lines the infolded flaps.
FIG. 8 is a plan view.
FIG. 9 is a perspective view of the finished box.

The blank indicated generally at 2 in FIG. 1 is formed as an elongated body of uniform width scored transversely along the score lines 4, 6 and 8 for folding of the elongated body into a four-sided box-like structure having side panels 10, 12, 14 and 16. The panel 16 at one end of the elongated body has a flap or tab 18 coated with a water-moistenable adhesive 20 as indicated to secure the blank in a box-like structure of predetermined configuration, in this instance square, when the elongated body is folded on the said score lines 4, 6 and 8 and the tab 18 is infolded and secured to the inner surface of the opposite panel 10 as shown in FIG. 4.

At 22 is an end or, in this instance, top panel, conforming in its periphery to the peripheral configuration of the box-like structure, joining the elongated body along an inner score line 24 co-extensive with the side panel 12. The panel 22 extends laterally from the panel 12 to an infolding tab 26 which joins the panel 22 at an outer score line 28. At opposite ends of the score line 28 the tab 26 is notched to a predetermined depth as shown at 30 and 32.

Side panel 10 has a flap 34 joining the panel at a score line 36. The flap joins the blank body only along the said score line and is free of the top panel 22 as indicated in FIG. 3. Flap 34 at its left-hand extremity (FIG. 1) is cut away in steps to provide a locking shoulder 38 of a height slightly less than the depth of the corresponding notch 30 to interlock therewith, the shoulder 38 being slightly recessed at 39 from alignment with the edge 37 of the blank, — all for a purpose which will appear.

Panel 14 has a flap 40 joining the panel at score line notched to provide the locking shoulder 44, recessed at 45, similar to notched to provide the recessed locking shoulder 44 similar to the shoulder 38 but adapted to interlock with notch 32.

When the box body is folded into its box-like structure, as indicated in FIG. 2, panel 16 is positioned opposite the inner score line 24 joining top panel 22 and side panel 12. When the flaps 34 and 40 are infolded and the top panel folded down, tab 26 is infolded to engage the inner surface of said opposite panel 16. It will be noted that the locking shoulders 38 and 44 are now positioned at opposite sides of panel 16 (FIG. 5), against the inner surface of which tab 26 is adapted to be infolded. As the top panel is lowered into closed position, tab 26 is inserted against the inner surface of panel 16 through the spaces afforded by recesses 39 and 45 in the cut-away portions. As the closing motion is completed, shoulders 38 and 44 snap into locking position with the notches 32 and 30, respectively. In that way the top panel is effectively locked in position.

Top panel 22 is slotted at 49 for the reception of coins in the intended usage of the box made from my novel blank as a dispensable coin savings bank.

The box has another end or bottom panel 50 joining side panel 16 at inner score line 52 and having tab 54 joining the panel at the outer score line 56 and provided with locking notches 58 and 60 which may be identical to those described above in connection with the top panel 22.

Side panel 10 is provided with a flap 66 joining the panel at a score line 68. The flap is notched to provide the recessed locking shoulder 70. Panel 14 similarly is provided with a flap 72 joining the panel at score line 74 and notched to provide a recessed locking shoulder 80. When the blank is folded in its position of FIGS. 2, 3 and 4, panel 12 is disposed opposite score line 52 by which the bottom panel 50 joins the blank body. Consequently, when the bottom panel 50 is folded along the score line 52, flap 54 is adapted to be infolded against the inner surface of said opposite panel 12. Prior to such folding of the bottom panel, flaps 66 and 72 are infolded along their score lines 68 and 74 whereupon panel 50 is folded to closed position over flaps 66 and 72. Flaps 66 and 72 function to lock the bottom panel 50 in closed position by virtue of the locking shoulders 70 and 80 which snap into position in notches 58 and 60, respectively, in a manner analogous to that above described with reference to locking notches 30 and 32 of the top panel. Flaps 66 and 72 perform the further function of contributing strength to the bottom of the box thus formed thereby sustaining the weight of deposited coins and to that end the flaps when infolded to lie in the plane are about co-extensive with the area of the bottom panel 50.

The box structure formed from my novel blank is shown completed in FIG. 9.

The blank, as shown in FIG. 1, may conveniently be mailed to customers of a savings institution in an ordinary business envelope and can readily be folded and assembled by the recipient into an attractive and useful bank for saving coins or bills. In such assemblage the manner of folding will be quite apparent to the novice who will observe that adhesion is required only on the surface of one tab, the tab 18. Otherwise, the structure of the box is firmly secured by the interlocking of the notches and locking shoulders above described in an operation which is automatic and requires no expertise on the part of the customer of the bank.

I claim:

1. A scored blank adapted to be folded into the form of a closed container suitable for use as a disposable bank comprising when unfolded an elongated blank body of uniform width between longitudinal boundaries scored transversely into a plurality of side panels each having longitudinal and transverse boundaries, the said blank being adapted upon folding along the transverse score lines to be joined in a box-like structure of predetermined peripheral configuration and dimensions;

an adherable tab protruding from the transverse boundary of a side panel at one extremity of the blank body;

adhesive for securing the said tab to the opposite extremity of the blank body to retain the side panels as so joined;

an end panel, conforming in its periphery to the peripheral configuration and dimensions of the said box-like structure, joining the elongated body at one of its longitudinal boundaries along an inner score line co-extensive with one of said side panels and extending laterally therefrom;

an infolding tab joining the said end panel at an outer score line;

locking notches at both ends of said outer score line;

one of the side panels being positioned opposite said inner score line when the side panels are folded into the said box-like structure;

each of the side panels lying contiguous to said opposite panel when so folded having a transverse boundary in engagement with said opposite panel and having a flap which joins the said contiguous side panel at a score line and which extends laterally from the elongated body in the same direction as the said end panel extends, and a shoulder formed in each of said flaps in proximity to said opposite panel adapted to interlock with said notches to secure the end panel in closed position;

the said shoulder of each flap being recessed from alignment with the said boundary in engagement with said opposite panel to afford a spacing slot for the reception of said infolding tab between the shoulder and the inner surface of said opposite panel;

the blank having two such end panels extending laterally in opposite directions from the said blank body to form the top and bottom closing panels of the box-like structure; and one of said panels being slotted for the reception of coins.

* * * * *

UNITED STATES PATENT AND TRADEMARK OFFICE

CERTIFICATE OF CORRECTION

PATENT NO. : 3,963,165

DATED : June 15, 1976

INVENTOR(S) : Jan Hughes

It is certified that error appears in the above-identified patent and that said Letters Patent are hereby corrected as shown below:

Column 1, line 24, after "said" insert--side--;

Column 2, rewrite the paragraph appearing in lines 25-29 to read as follows:

--Panel 14 has a flap 40 joining the panel at score line 42 and notched at the end opposite that at which the flap 34 is notched to provide the locking shoulder 44 recessed at 45, similar to the shoulder 38 but adapted to interlock with notch 32.--

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*